US005553717A

United States Patent [19]

Minneman et al.

[11] Patent Number: 5,553,717

[45] Date of Patent: Sep. 10, 1996

[54] PORTABLE ORGANIZER

[75] Inventors: Steven W. Minneman, Clayton; Allen J. Minneman, Dayton, both of Ohio

[73] Assignee: MTM Molded Products Company, Dayton, Ohio

[21] Appl. No.: 153,883

[22] Filed: Nov. 17, 1993

[51] Int. Cl.[6] ..... A47F 7/00

[52] U.S. Cl. ..... 211/13; 211/64; 211/86; 248/156; 42/94; 206/315.11

[58] Field of Search ..... 211/64, 60.1, 13, 211/86, 88; 206/562, 563, 564, 557, 315.11; 42/94; 248/122, 156, 146

[56] References Cited

U.S. PATENT DOCUMENTS

| | | | |
|---|---|---|---|
| D. 162,207 | 2/1951 | Mettenleiter | D80/9 |
| 1,799,079 | 3/1931 | Bemis | 248/146 |
| 2,593,789 | 4/1952 | Pearson | 211/13 |
| 2,603,440 | 7/1952 | LeVesconte et al. | 248/156 X |
| 3,007,581 | 11/1961 | Moore | 211/64 |
| 3,022,898 | 2/1962 | Loeb | 211/64 |
| 3,156,062 | 11/1964 | Stevenson et al. | 42/94 |
| 3,584,820 | 6/1971 | Butcher, Sr. | 248/122 |
| 3,828,373 | 8/1974 | Fraley | 248/156 X |
| 3,952,878 | 4/1976 | Gorham | 211/64 |
| 3,986,649 | 10/1976 | Heimstra | 211/88 X |
| 3,991,780 | 11/1976 | Maroski, Jr. | 135/66 |
| 4,089,423 | 5/1978 | Gorham et al. | 211/64 |
| 4,144,971 | 3/1979 | Balibrea | 211/64 |
| 4,205,818 | 6/1980 | Lawler | 211/13 X |
| 4,271,969 | 6/1981 | Gnesa | 211/64 |
| 4,531,643 | 7/1985 | Bradley | 211/64 |
| 4,545,144 | 10/1985 | Schuster | 42/94 |
| 4,896,854 | 1/1990 | St. Laurent | 248/156 |
| 4,913,389 | 4/1990 | McCracken | 248/156 |
| 5,039,052 | 8/1991 | Carafice | 248/309 |
| 5,058,302 | 10/1991 | Minneman | 206/315.11 X |
| 5,111,800 | 5/1992 | Reynolds | 124/88 |
| 5,333,745 | 8/1994 | Lehmann | 211/88 |

*Primary Examiner*—Robert W. Gibson, Jr.
*Attorney, Agent, or Firm*—Jacox, Meckstroth & Jenkins

[57] ABSTRACT

This invention provides a method and apparatus for conveniently organizing weapon articles, such as rifles, shotguns, pistols, bows, arrows, ammunition, ammunition holders, eye and ear protection, muzzle loading equipment, tools, and the like for use outdoors. The organizer comprises a tray member having a plurality of organizing areas for receiving one or more of the weapon articles. The tray member also comprises a plurality of notched areas and a slotted member having a slot for supporting, for example, rifles and a gun cleaner, respectively. The tray member is mounted on an I-shaped support which has a rung or engaging member towards a planting end thereof to facilitate forcing at least spike located on the planting end into the ground. The organizer enables a shooter or archer to organize and support weapon articles at any desired location a predetermined distance above the ground to make it convenient and easy for them to shoot.

35 Claims, 9 Drawing Sheets

30e
12
24b
10
30f
20
34
12a
18
24d
42
32
33
30h
30g
24c
22
43
31
29
38
30
27
36
26b
34
41
36
38
35
30d
26c
28
24a
25
30c
40
Y
X
30a
30b
26a
14
50
60
52
58
14b
62
54
56

34
20
18
30e
30f
42
32
24c
30g
24d
30h
31
33
43
22
38
30
27
29
34
36
41
16
38
35
14d
30d
30c
25
40
30a
30b
14a
14
50
60
D
58
52
14b
A
62
54
56

PORTABLE ORGANIZER

BACKGROUND OF THE INVENTION

1. Field of the Invention

This invention relates to a portable organizer, and more particularly, it relates to a multi-purpose portable organizer for organizing and supporting weapon articles.

2. Description of the Related Art

It is not uncommon for a shooter and archer during hunting or practice to place his weapon articles, such as weapons, ammo and accessories on the ground simply because he does not have a way to easily organize and support the weapon articles. Many times the archer or hunter has difficulty organizing his weapons and accessories for easy access use.

Some portable supports for bows and arrows are known in the art. For example, U.S. Pat. Nos. 3,007,581, 3,022,898, 3,156,062, 3,584,820, 4,089,423, 4,144,971, 3,952,875, 3,991,780, 4,271,969, 5,039,052, and U.S. Pat. No. Des. 162,207, all disclose weapon supports. However, these devices do not provide a multi-purpose organizer for providing a stand which is capable of receiving a variety of weapon articles, including tools and accessories associated therewith, in a manner which will organize them into a predetermined or desired order.

Further, the weapon supports disclosed in these patents are typically designed for use with only one particular type of weapon and are thus of limited use. Yet another disadvantage associated with prior weapon supports relates to the height at which the weapon articles are supported wherein the weapon articles are typically positioned at a low, inconvenient height requiring a person to bend over to use the weapon support.

SUMMARY OF THE INVENTION

In one aspect, this invention comprises an organizer for organizing weapon articles, the organizer comprising a tray member, an elongated support, and a connector for detachably connecting the tray member to the elongated support, the tray member comprising structure defining a plurality of organizing areas for receiving the weapon articles in order to organize them into a predetermined order.

In another aspect of the invention this invention comprises a weapon organizer comprising a planar tray member, at least one wing located on a side of the planar tray member, a support for supporting the planar tray member above the ground; and a connector for detachably connecting said planar tray member to the support, the planar tray member and at least one wing providing a first organizing area and a second organizing area, respectively.

In yet another aspect of the invention, this invention comprises a portable organizer for use with weapon articles, comprising a tray member, an elongated support member having tray mounting end and a planting end having at least one spike, an engaging member associated with the planting end for facilitating forcing the spike into the ground; and a connector coupled to an underside of the tray member to facilitate mounting the tray member on the mounting end of said elongated support member.

In still another aspect of the invention this invention comprises a method for organizing weapon articles, comprising the steps of detachably mounting a tray member on a mounting end of an elongated support, forcing a planting end of the elongated support into the ground, and placing the weapon articles into at least one of a plurality of organizing areas on the tray member.

It is an object of this invention to provide a very portable and durable organizer for organizing weapon articles.

It is still another object of this invention to provide an organizer which can be molded from plastic.

Still another object of this invention is to provide an organizer which facilitates organizing weapon articles.

Still another object of this invention is to provide an organizer which provides a generally planar platform at the desired operating distance from the ground.

Still another object of this invention is to provide a portable organizer which is capable of supporting a plurality of weapon articles, such as rifles, pistols, ammunition and accessories, like eye and ear protection.

Another object of this invention is to provide an organizer which will provide a platform to provide a place for a shooter or archer to put weapon articles at a predetermined height above the ground, thereby enabling the shooter or archer to avoid having to bend over.

Still another object of the invention is to provide a multipurpose portable organizer which conveniently organizes and supports a variety of weapon articles including accessories and tools.

Yet another object is to provide an organizer that facilitates the safe use of weapons.

These advantages, objects and others, may be more readily understood in connection with the following specification, claims and drawing.

DETAILED DESCRIPTION OF THE INVENTION

Figure 1:
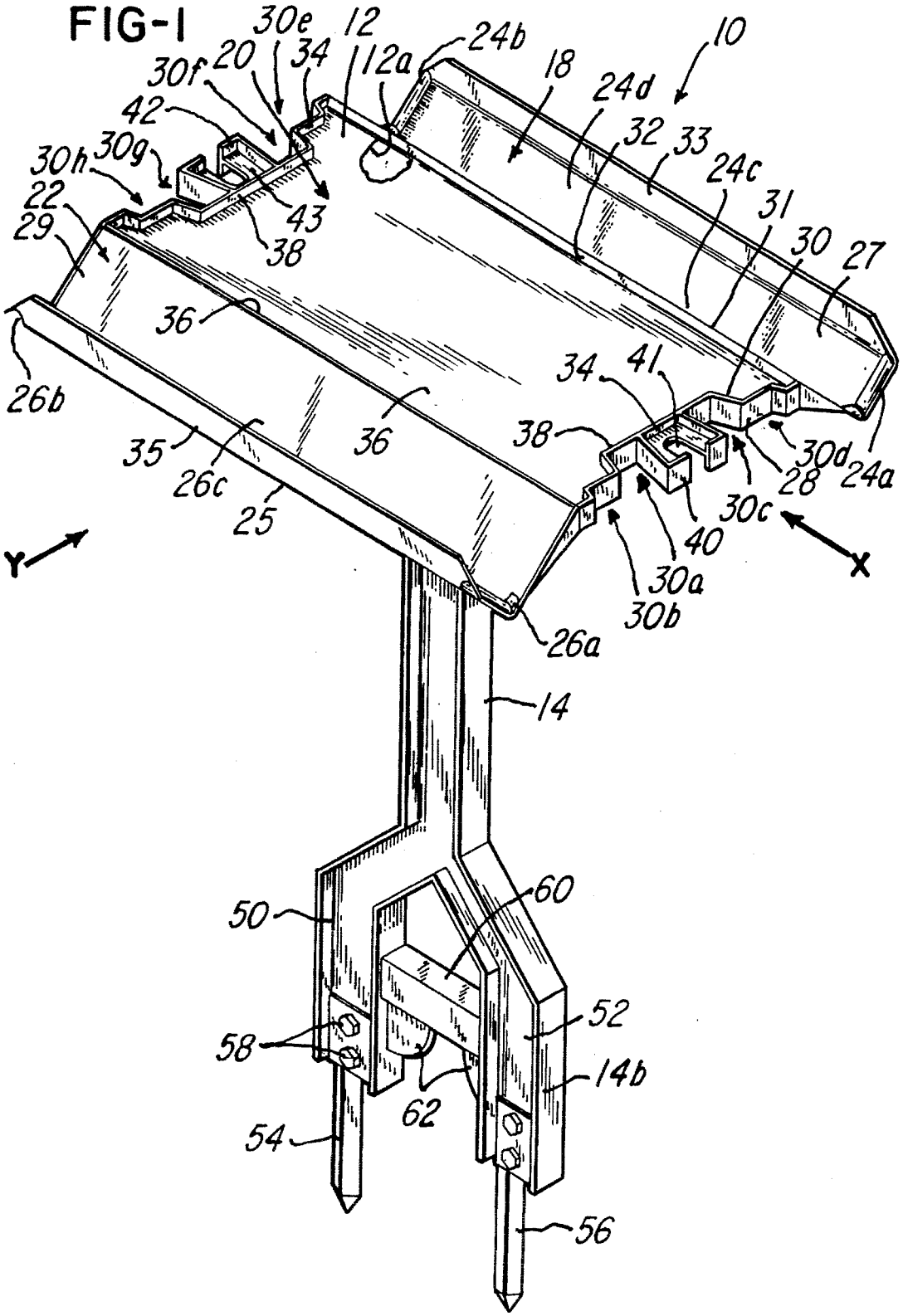
FIG. 1 is a perspective view of an organizer according to one embodiment of the invention.
Figure 7:
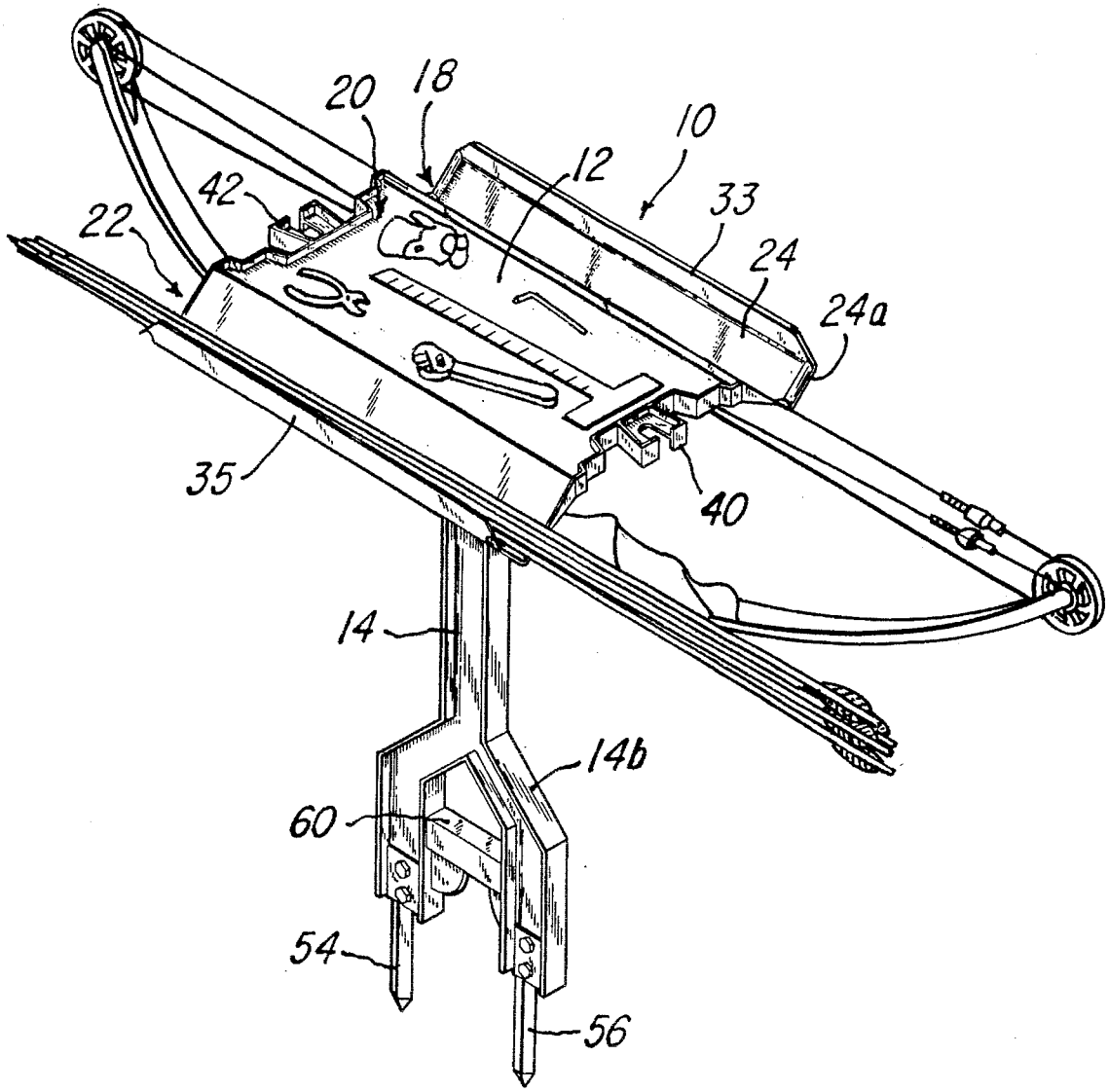
FIG. 7 is a view showing various weapon articles organized on the organizer.
Figure 8:
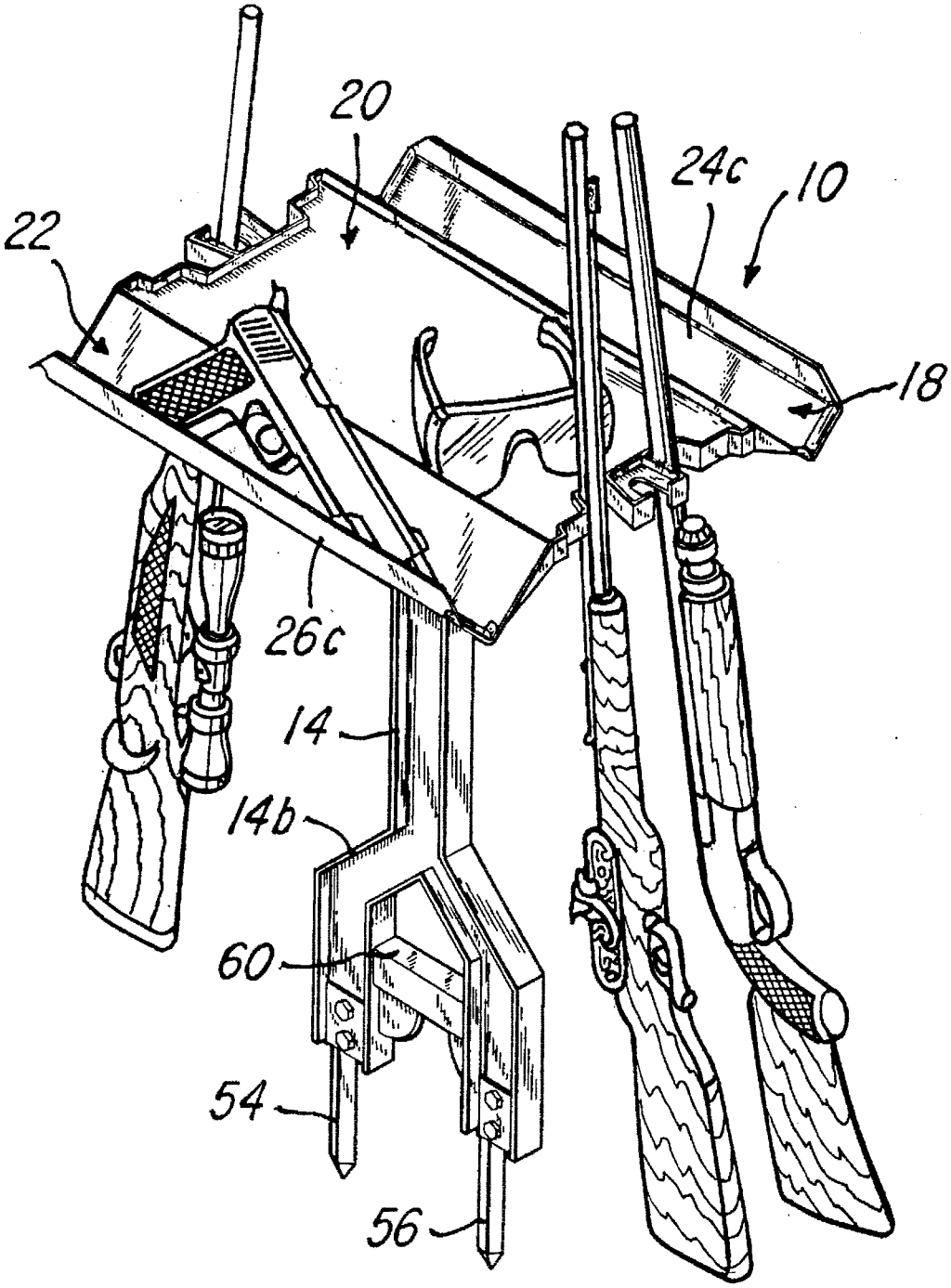
FIG. 8 is another view showing other weapon articles organized on the organizer.
Figure 9:
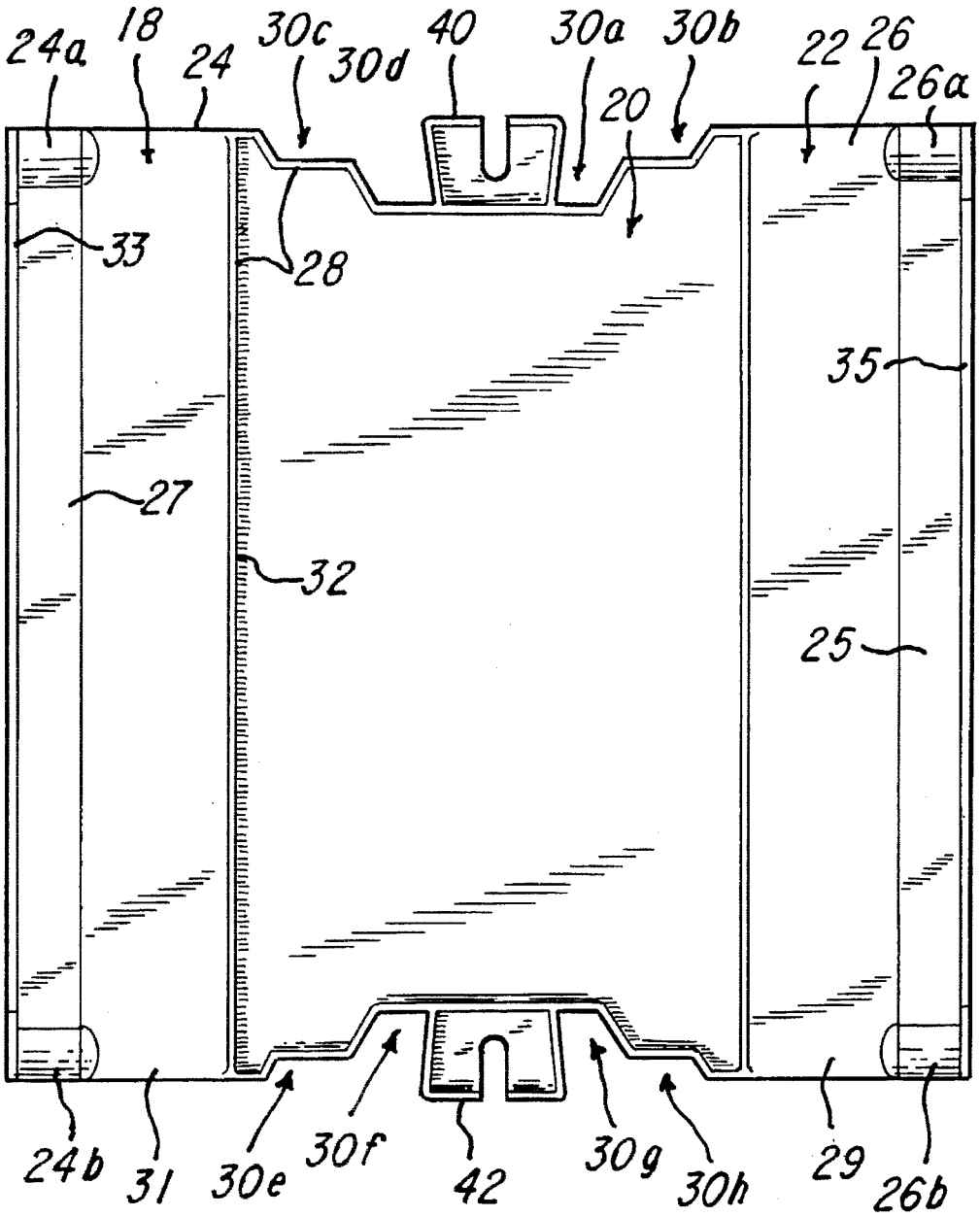
FIG. 9 is a top view of the tray member.

Referring now to FIG. 1, an organizer 10 for organizer weapon articles is shown. The organizer 10 comprises a tray member 12, an elongated support 14 and a connector 16 (FIG. 2) for detachably connecting tray 10 to elongated support 14. In the embodiment being described, the tray member 12 comprises structure defining a plurality of organizing areas, such as areas 18, 20 and 22. The organizing areas 18, 20 and 22 are capable of receiving weapon articles in order to organize them into a predetermined or desired order. As best illustrated in FIGS. 7 and 8, the weapon articles may comprise a variety of different weapons, armatures and tools associated therewith. For example, the weapon articles may include pliers, Alan wrenches, crescent wrenches and other tools for adjusting weapons and armatures as well as weapons such as bows, arrows, rifles, shotguns, pistols, rifle and pistol ammunition, and safety devices such as goggles, ear plugs, ear muffs, gloves and the like. The weapon articles may also comprise targets utilized during target practice, a scope for viewing downrange targets and a case for holding spent and unspent shells. In addition, the weapon articles may also comprise items utilized during skeet shooting such as clay pigeons and hand-held clay pigeon throwers.

Figure 2:
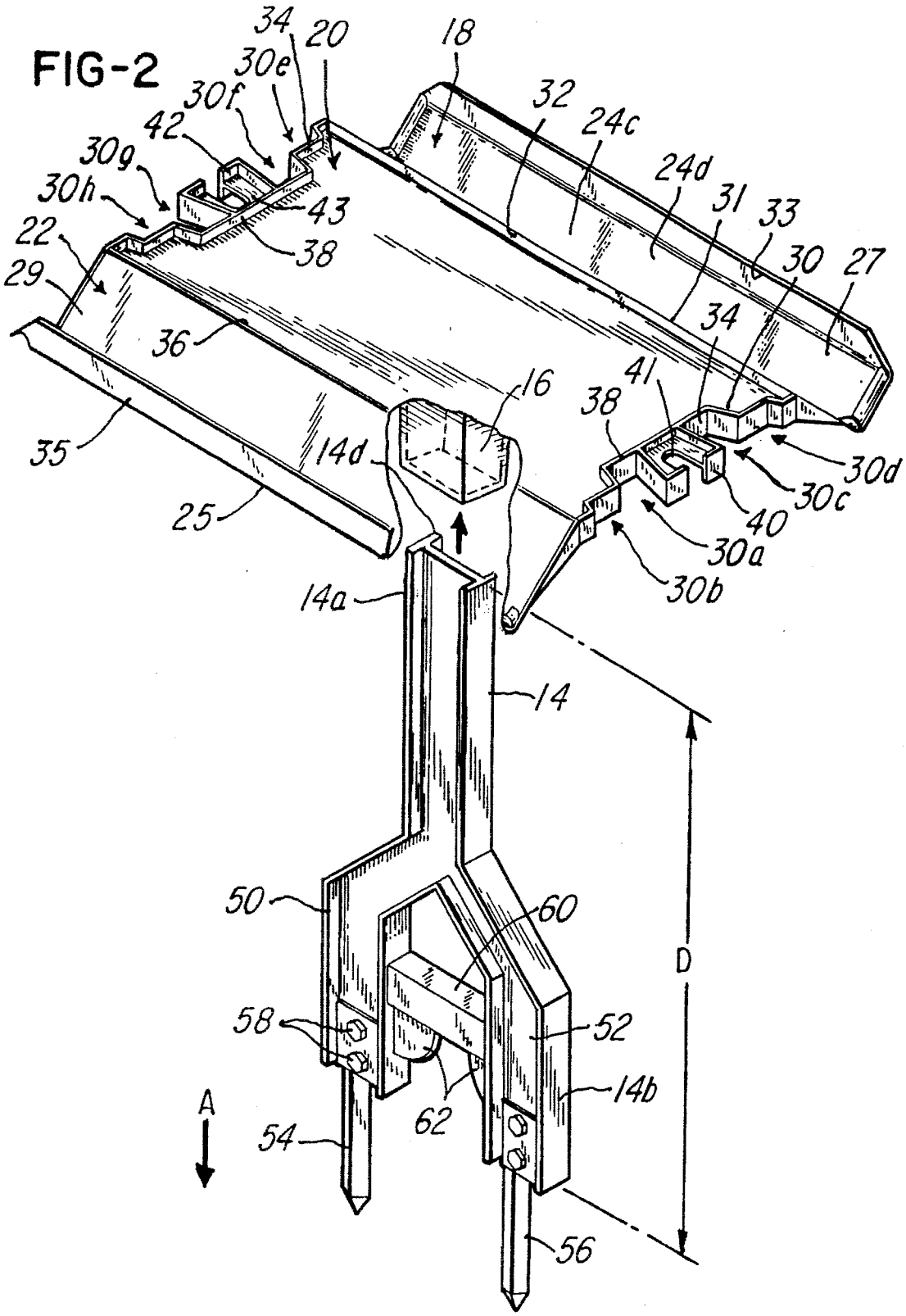
FIG. 2 is a fragmentary view of the organizer shown in FIG. 1.
Figure 3:
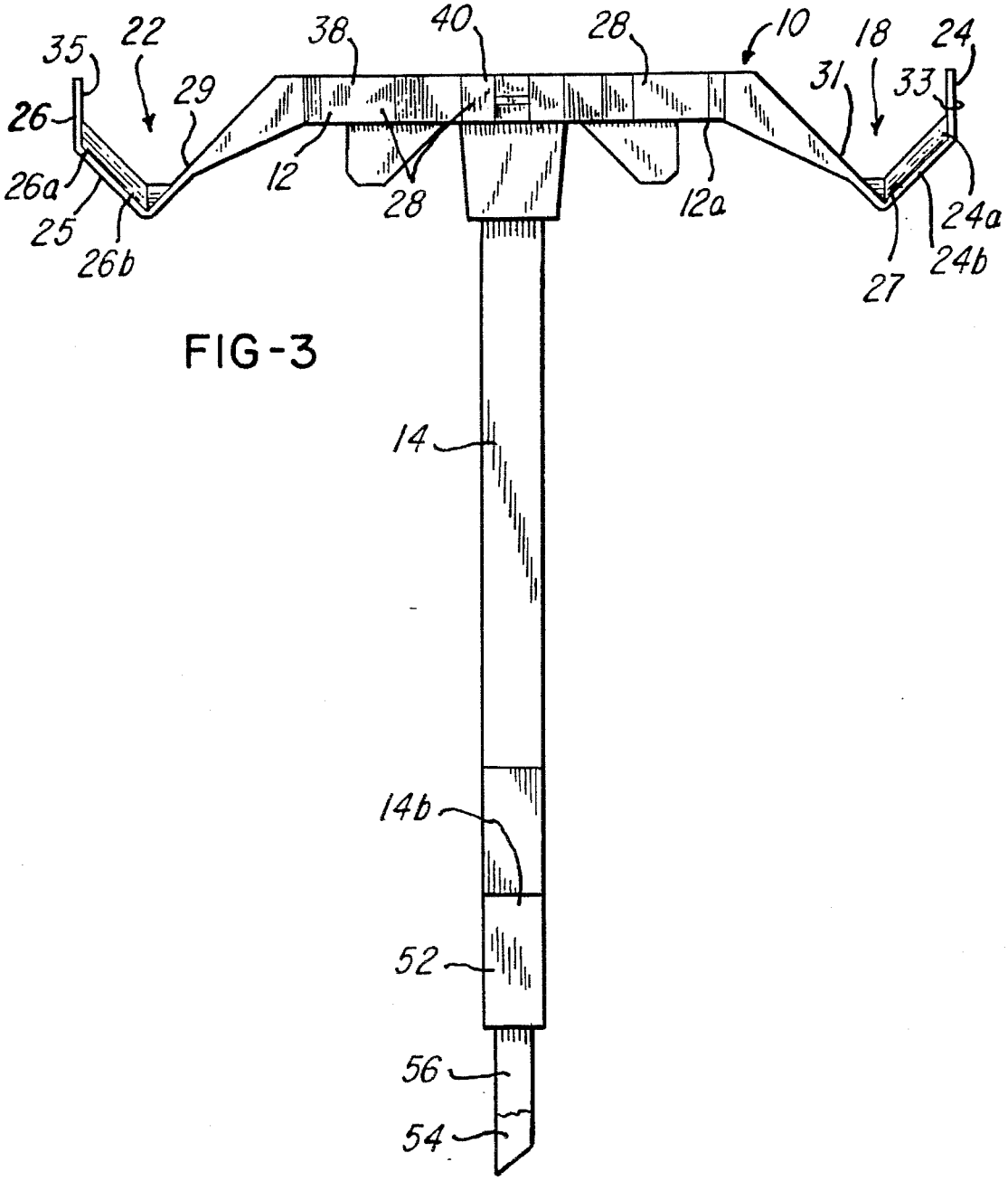
FIG. 3 is a side view taken in the direction of arrow X in FIG. 1.
Figure 4:
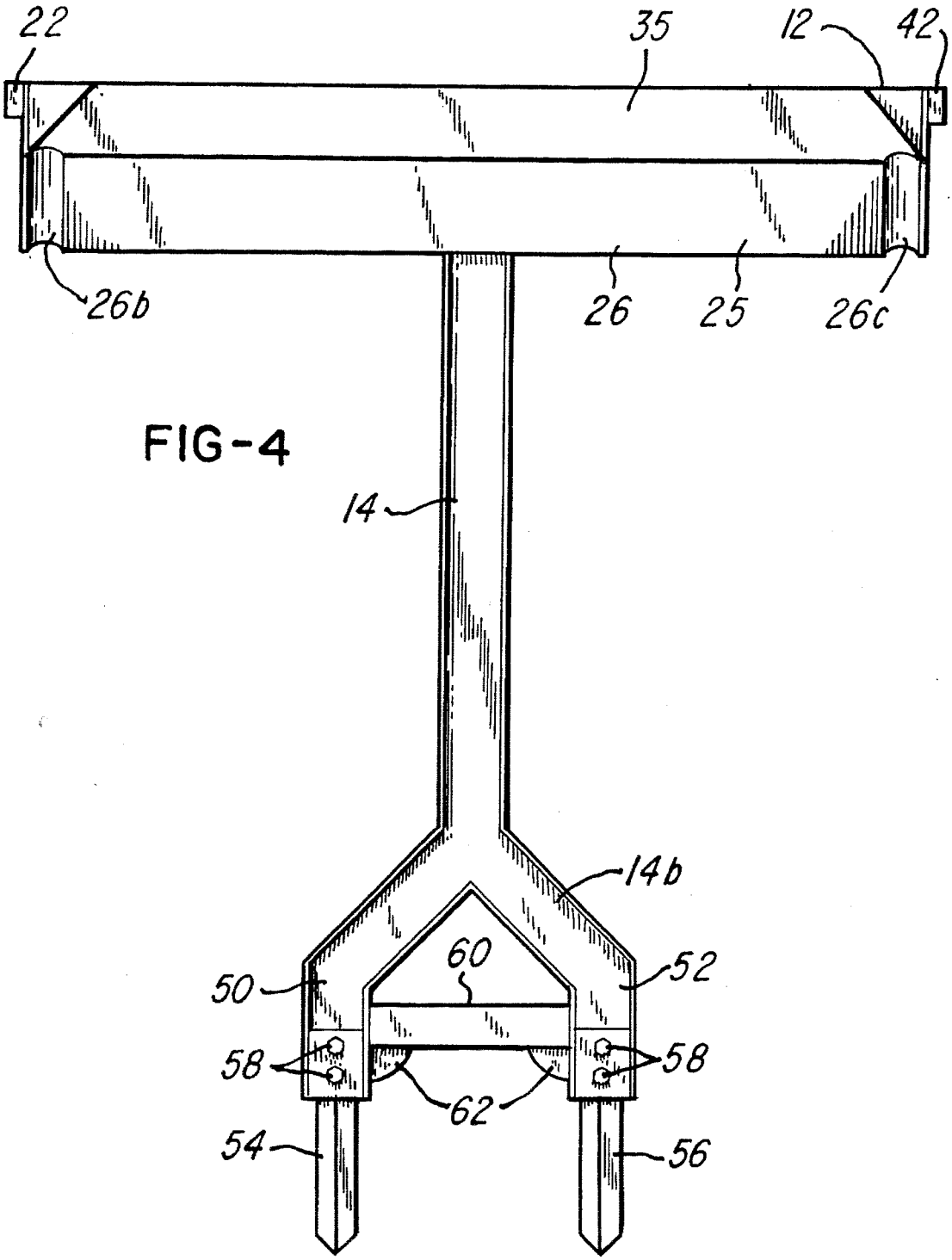
FIG. 4 is a front view of the organizer taken in the direction of arrow Y in FIG. 1.
Figure 5:
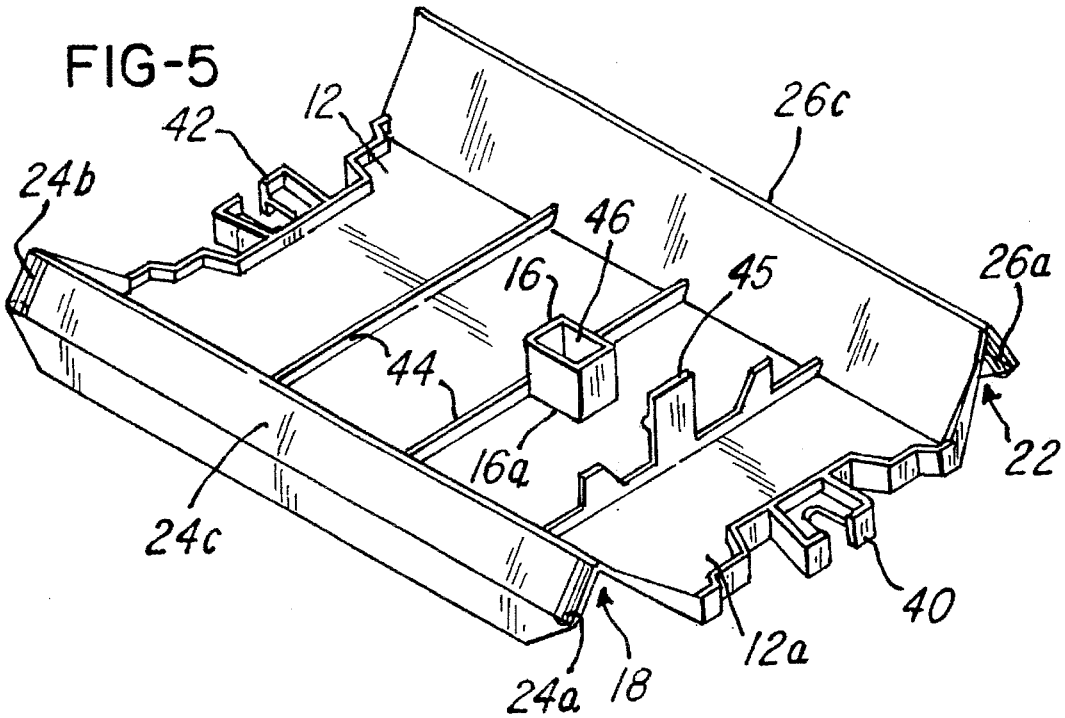
FIG. 5 is a bottom view of a tray member portion of the organizer shown in FIG. 1.

In the embodiment being described, organizing areas 18 and 22 each comprises at least one wing or trough 24 and 26 which may be utilized to organize or support one or more of the above-mentioned weapons articles illustrated in FIGS. 7 and 8. As best illustrated in FIGS. 3 and 5, the troughs 24 and 26 are generally U-shaped in cross-section. Troughs 24 and 26 each comprises bottoms 25, 27, walls 29 and 31 and flanges 33 and 35, as shown in FIGS. 1 and 2. It should be appreciated that the troughs 24 and 26 could be V-shaped or any other shape which is suitable for providing an organizing area 18 and 22. Also, the troughs 24 and 26 may include organizing compartments (not shown) or areas which divide these organizing areas 24 and 26 into smaller organizing areas. It is to be noted that each of the troughs 24 and 26 are generally elongated and comprise a pair of ridge portions 24*a* and 24*b*, 26*a* and 26*b*, respectively, which provide ends to the troughs 24 and 26 to define storage areas 24*c* and 26*c* within the troughs. The ridge portions 24*a*, 24*b*, 26*a* and 26*b* also facilitate keeping weapon articles within the trough. The ridge portions 24*a*, 24*b*, 26*a* and 26*b* also facilitate supporting weapon articles above the storage areas 24*c* and 26*c*. For example, as illustrated in FIG. 7, a bow may be supported by its bow strings on ridge portions 24*a* and 24*b* such that the entire bow string does not engage wall 24*d* of trough 24. As best illustrated in FIGS. 1–4 and 10, the ridge portions are generally U-shaped in cross-section, but they could be planar, V-shaped or any suitable shape for providing a wall or support member which provides the function of the ridge portion.

In the embodiment being described, the tray member 12 is generally planar and comprises an organizing area 20 which is generally rectangular and also comprises a generally rectangular receiving area for receiving one or more of the weapon articles. It is to be noted that the tray member 12 comprises a wall portion 28 which facilitates defining the receiving area 20. As best illustrated in FIGS. 1–6 and 9–10, the wall portion 28 comprises at least one notch, such as notched areas 30*a*, 30*b*, 30*c*, 30*d*, 30*e*, 30*f*, 30*g*, and 30*h*. As best illustrated in FIG. 8, the notched areas facilitate supporting at least one gun or rifle barrel in an upright manner.

Figure 6:
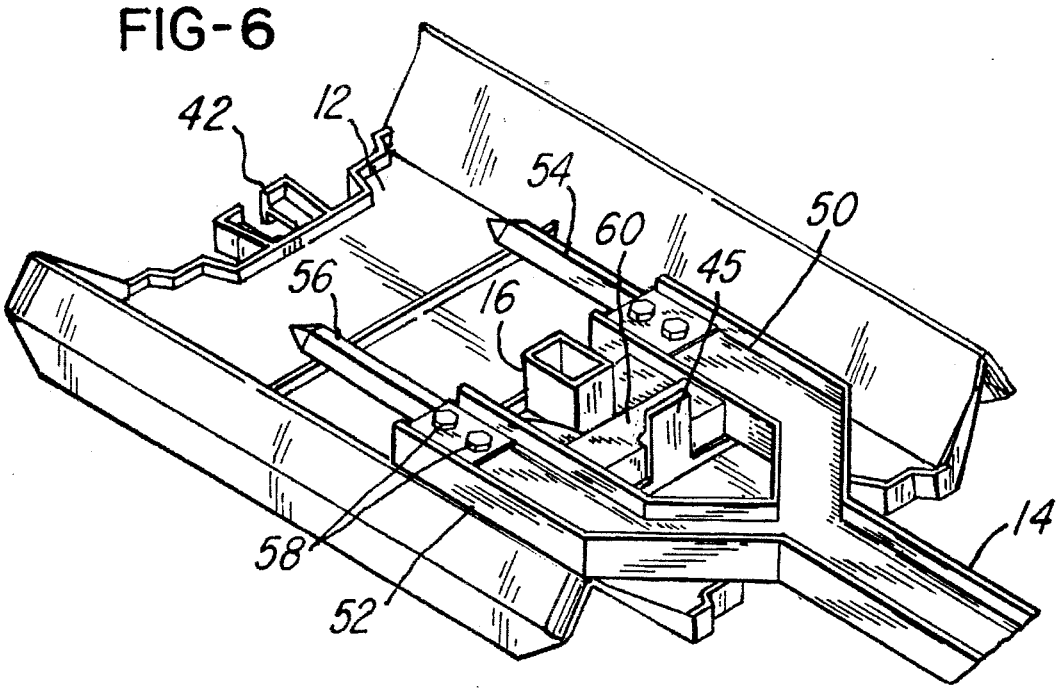
FIG. 6 is a fragmentary view showing how the underside of the tray member can be detachably mounted to a planting end of the support member for transporting the organizer.
Figure 10:
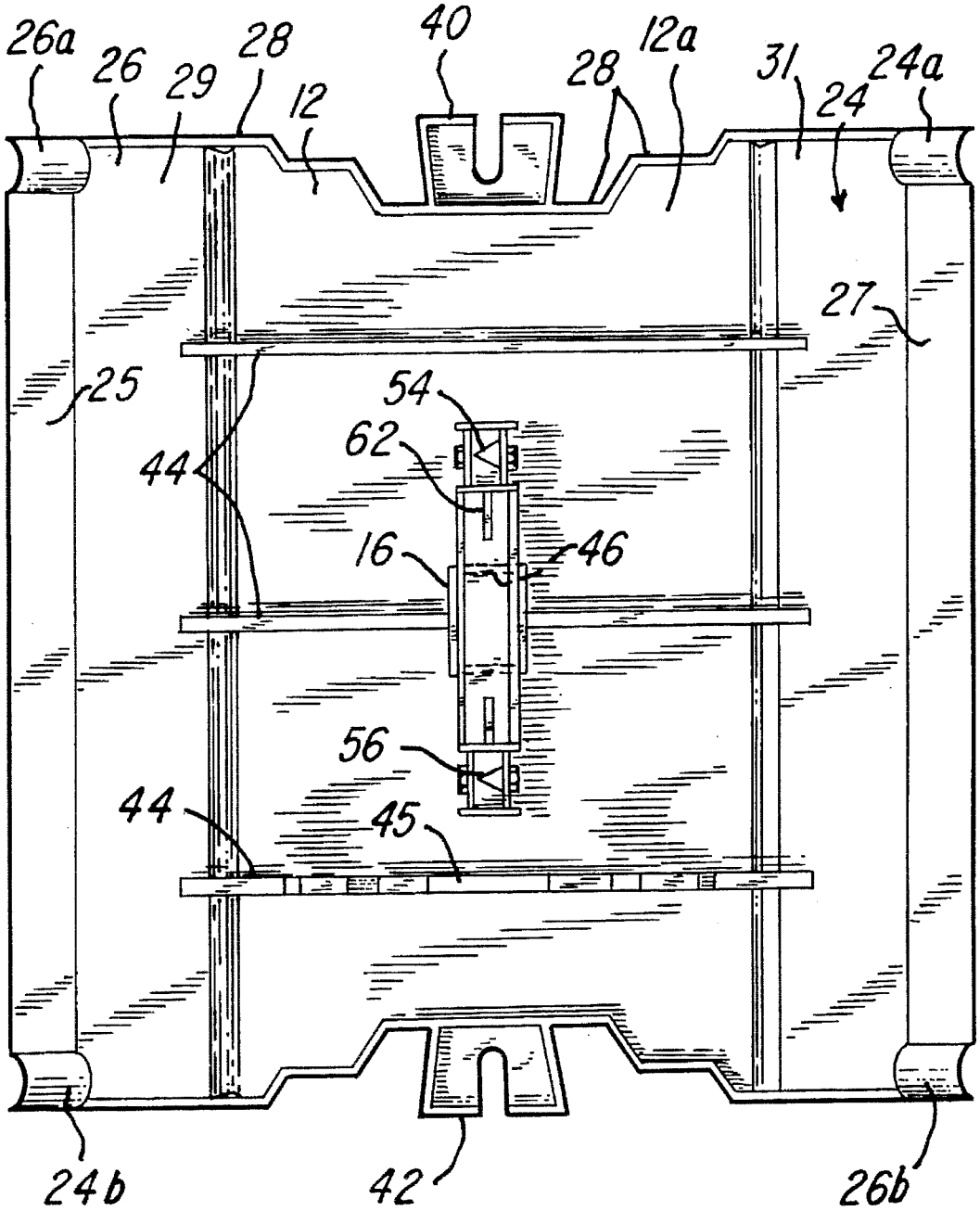
FIG. 10 is a bottom view of the organizer shown in FIG. 1.

In the embodiment being described, the wall portion 30 comprises walls 32 and 34 which are generally opposed to walls 36 and 38, respectively. As illustrated in FIGS. 1–6 and 9–10, walls 30 and 34 each comprise at least one slotted member 40 and 42, respectively, having a slot 41 and 43 therein which is capable of removably supporting a weapon article such as a rifle cleaning rod (not shown), or arrows (FIG. 7). As illustrated in FIGS. 4 and 10, an underside 12*a* of the tray member 12 comprises a plurality of strengthening ribs 44 which facilitate strengthening the tray member 12. As best illustrated in FIG. 4, the connector 16 has one end 16*a* integrally formed to the underside 12*a* of tray member 12. The connector 16 is generally rectangular and defines a receiving area 46 (FIGS. 4 and 10) for receiving elongated support 14. Notice also that underside 12*a* also comprises a retainer or detent 45 associated with connector 16 and which cooperates with connector 16 to secure the tray member 12 to planting end 14*b* of support member 14 when the organizer is being transported (FIG. 6). This feature facilitates making the organizer 10 very portable and easy to carry.

As shown in FIG. 2 support member 14 comprises a mounting end 14*a* and planting end 14*b*. The support member is generally I-shaped in cross section and, as mentioned above, is received in receiving opening 46 of connector 16 when tray member 12 is mounted on support member 14. The planting end 14*b* of support member 14 is generally Y-shaped and comprises a first leg 50 and second leg 52 each having at least one metal spike 54 and 56, respectively, secured thereto by any suitable fasteners such as screws 58 and bolts.

It should be appreciated, however, that spikes 54 and 56 could be plastic or they could be integrally molded or formed as part of legs 50 and 52, respectively.

The planting end 14*b* of support member 14 also comprises an engaging member 60 which connects the first and second legs 50 and 52 to provide a rung which facilitates forcing spikes 54 and 56 into the ground, for example, by foot pressure. In the embodiment being described, the engaging member 60 is integrally molded or formed between legs 50 and 52. Notice also that engaging member 60 comprises strengthening ribs 62 which facilitate strengthening planting end 14*b*. It should be appreciated that planting end 14*b* could be configured in other shapes and sizes and could be any suitable shape which is capable of securing the support member 14 generally vertical or perpendicular to the ground in which the organizer 10 is planted. It should also be appreciated that mounting end 14*a* generally complements the shape and configuration of receiving area 46 so that the tray member 12 can be mounted snugly thereto.

In the embodiment being described, the support member 14 has a suitable length D (FIG. 2) which enables the tray member 12 to be secured a predetermined or desired distance from the ground which is preferably not more than 36 inches.

In the embodiment being described, the organizer 10 is generally 13 inches by 13 inches by 32 inches (after organizer 10 is planted in the ground). The tray member 12 and support member 14 are each a one-piece construction molded from plastic. In the embodiment being described, tray member 12 is molded from a high impact grade plastic so as to provide a durable construction which does not easily chip, break or crack. A method for organizing weapon articles using the organizer 10 will now be described.

The connector 16 on tray member 12 is generally aligned with mounting end 14*a* (FIG. 2) of support member 14 such that mounting end 14*a* can be slid into receiving opening 46 until an end 14*d* of mounting end 14*a* engages underside 12*a*. The planting end 14*b* is then forced downward in the direction of arrow A in FIG. 2 until spikes 54 and 56 are firmly planted in the ground. To facilitate forcing planting end 14*b* into the ground, it may be desired for a user to place his or her foot on engaging member 60 to force planting end 14*b* in the direction of arrow A. Once the organizer 10 is firmly planted in the ground, the weapon articles, such as those shown in FIGS. 7 and 8, may be placed in organizing areas 18, 20 and 22, thereby enabling a user to organize and support said weapon articles in a predetermined order. After the organizer 10 is used, tray 12 is dismounted from mounting end 14*a* and support member 14 is unplanted from the ground. As best shown in FIG. 6, the planting end 14*b* of support member 14 may then be positioned such that engaging member 60 is receiving between connector 16 and retainer 45, thereby making the organizer 10 portable and easy to transport.

Advantageously, the organizer 10 provides a multi-purpose portable organizer for organizing weapon articles and for providing a useful platform that makes using the weapon articles more convenient and organized. The organizer 10 can be used by archers, shooters, black powder shooters and the like.

Notice also that the organizer 10 is vertical and can be used for other purposes, such as supporting a telescope for viewing targets downrange, providing arm support during rifle shooting.

Various changes or modifications in the invention described may occur to those skilled in the art without departing from the true spirit or scope of the invention. The above description of the invention is intended to be illustrative and not limiting and it is not intended that the invention be restricted thereto but that it be limited only by the true spirit and scope of the appended claims.

What is claimed is:

1. An organizer for organizing weapon articles, said organizer comprising:

a tray member for receiving said weapon articles;

an elongated support for supporting the tray member on the ground; and a connector for detachably connecting said tray member to said support;

said tray member comprising structure defining a plurality of organizing areas for receiving said weapon articles in order to organize them into a predetermined order;

wherein said plurality of organizing areas comprises at least one trough.

2. The organizer as recited in claim 1 wherein said trough is generally U-shaped in cross section.

3. The organizer as recited in claim 2 wherein a portion of said tray member is generally planar and said trough is located on a side thereof.

4. An organizer for organizing weapon articles, said organizer comprising:

a tray member;

an elongated support; and a connector for detachably connecting said tray member to said elongated support;

said tray member comprising structure defining a plurality of organizing areas for receiving said weapon articles in order to organize them into a predetermined order, said tray member comprising a wall portion comprising at least one notched area for supporting at least one gun barrel.

5. An organizer for organizing weapon articles, said organizer comprising:

a tray member;

an elongated support; and a connector for detachably connecting said tray member to said elongated support;

said tray member comprising structure defining a plurality of organizing areas for receiving said weapon articles in order to organize them into a predetermined order, said tray member comprising a wall portion defining at least two opposing walls, said at least two opposing walls each having at least one notched area for supporting at least one gun barrel.

6. The organizer as recited in claim 4 wherein said weapon article comprises a rifle cleaning rod, said wall portion comprises at least one slotted member comprising a slot which is capable of removably supporting said rifle cleaning rod.

7. An organizer for organizing weapon articles, said organizer comprising:

a tray member;

an elongated support; and a connector for detachably connecting said tray member to said elongated support;

said tray member comprising structure defining a plurality of organizing areas for receiving said weapon articles in order to organize them into a predetermined order, said elongated support member comprising a planting end and a mounting end; said planting end comprising at least one stake member for securing the organizer into the ground such that said tray member is positioned a predetermined distance above the ground.

8. The organizer as recited in claim 7 wherein said predetermined distance is not more than 36 inches.

9. The organizer as recited in claim 7 wherein said planting end is generally Y-shaped.

10. The organizer as recited in claim 7 wherein said planting end comprises an engaging member for facilitating forcing said stake into the ground.

11. The organizer as recited in claim 10 wherein said planting end comprises a first leg member and a second leg member, said engaging member being located between said first and second leg members.

12. An organizer for organizing weapon articles, said organizer comprising:

a tray member;

an elongated support; and a connector for detachably connecting said tray member to said elongated support;

said tray member comprising structure defining a plurality of organizing areas for receiving said weapon articles in order to organize them into a predetermined order;

said connector is generally tubular and has an end coupled to said tray member so as to define a receiving area for detachably receiving a mounting end of said elongated support.

13. An organizer for organizing weapon articles, said organizer comprising:

a tray member;

an elongated support; and a connector for detachably connecting said tray member to said elongated support;

said tray member comprising structure defining a plurality of organizing areas for receiving said weapon articles in order to organize them into a predetermined order, said connector is generally tubular and has an end coupled to said tray member so as to define a receiving area for detachably receiving a mounting end of said elongated support, said connector being generally rectangular in cross section.

14. An organizer for organizing weapon articles, said organizer comprising:

a tray member;

an elongated support; and a connector for detachably connecting said tray member to said elongated support;

said tray member comprising structure defining a plurality of organizing areas for receiving said weapon articles in order to organize them into a predetermined order, said organizer further comprising a retainer associated with said connector for securing said tray member to a planting end of said support member to facilitate transporting said organizer.

15. An organizer for organizing weapon articles, said organizer comprising:

a tray member;

an elongated support; and a connector for detachably connecting said tray member to said elongated support;

said tray member comprising structure defining a plurality of organizing areas for receiving said weapon articles in order to organize them into a predetermined order, said plurality of organizing areas comprises at least one trough said at least one trough comprising a first end and a second end each having a ridge portion for defining a storage area within the trough and also for facilitating supporting some of the weapon articles above the storage area.

16. A weapon organizer comprising:

a planar tray member;

at least one wing located on a side of said planar tray member;

a support for supporting said planar tray member above the ground; and a connector for detachably connecting said planar tray member to said support;

said planar tray member and said at least one wing providing a first organizing area and a second organizing area, respectively, said wing being generally U-shaped in cross section.

17. A weapon organizer comprising:

a planar tray member;

at least one wing located on a side of said planar tray member;

a support for supporting said planar tray member above the ground; and a connector for detachably connecting said planar tray member to said support;

said planar tray member and said at least one wing providing a first organizing area and a second organizing area, respectively, said tray member comprises a wall portion comprising at least one notched capable of supporting at least one gun barrel, said wall portion comprising at least one slotted member comprising a slot for supporting a weapon article.

18. A weapon organizer comprising:

a planar tray member for receiving a plurality of weapon articles;

at least one wing located on a side of said planar tray member;

a support for supporting said planar tray member a predetermined distance above the ground; and a connector for detachably connecting said planar tray member to said support;

said planar tray member and said at least one wing providing a first organizing area and a second organizing area, respectively, wherein said support member comprises a planting end and a mounting end; said planting end comprising at least one stake member for securing the weapon organizer into the ground such that said tray member is positioned the predetermined distance above the ground.

19. A weapon organizer comprising:

a planar tray member for receiving a plurality of weapon articles;

at least one wing located on a side of said planar tray member;

a support for supporting said planar tray member above the ground; and a connector for detachably connecting said planar tray member to said support;

said planar tray member and said at least one wing providing a first organizing area and a second organizing area, respectively;

wherein said planar tray member is supported above the ground a predetermined distance; said predetermined distance being not more than 36 inches.

20. The weapon organizer as recited in claim 18 wherein said planting end is generally Y-shaped.

21. The weapon organizer as recited in claim 18 wherein said planting end further comprises an engaging member for facilitating forcing said stake into the ground.

22. A weapon organizer comprising:

a planar tray member;

at least one wing located on a side of said planar tray member;

a support for supporting said planar tray member above the ground; and a connector for detachably connecting said planar tray member to said support;

said planar tray member and said at least one wing providing a first organizing area and a second organizing area, respectively, said support member comprises a planting end and a mounting end; said planting end comprising at least one stake member for securing the weapon organizer into the ground such that said tray member is positioned the predetermined distance above the ground, said planting end comprising a first leg member and a second leg member, said engaging member being located between said first and second leg members.

23. A weapon organizer comprising:

a planar tray member;

at least one wing located on a side of said planar tray member;

a support for supporting said planar tray member above the ground; and a connector for detachably connecting said planar tray member to said support;

said planar tray member and said at least one wing providing a first organizing area and a second organizing area, respectively, said connector being generally tubular and has an end coupled to said tray member so as to define a receiving area for detachably receiving a mounting end of said elongated support.

24. A weapon organizer comprising:

a planar tray member;

at least one wing located on a side of said planar tray member;

a support for supporting said planar tray member above the ground; and a connector for detachably connecting said planar tray member to said support;

said planar tray member and said at least one wing providing a first organizing area and a second organizing area, respectively, said connector being generally rectangular in cross section.

25. A weapon organizer comprising:

a planar tray member;

at least one wing located on a side of said planar tray member;

a support for supporting said planar tray member above the ground; and a connector for detachably connecting said planar tray member to said support;

said planar tray member and said at least one wing providing a first organizing area and a second organizing area, respectively, said weapon organizer further comprising a retainer associated with said connector for securing said tray member to a planting end of said support member to facilitate transporting said weapon organizer.

26. A weapon organizer comprising:

a planar tray member;

at least one wing located on a side of said planar tray member;

a support for supporting said planar tray member above the ground; and a connector for detachably connecting said planar tray member to said support;

said planar tray member and said at least one wing providing a first organizing area and a second organizing area, respectively, said at least one wing comprising a first end and a second end each having a ridge portion for defining a storage area within the wing and also for facilitating supporting some of the weapon articles above the storage area.

27. A weapon organizer comprising:

a planar tray member;

at least one wing located on a side of said planar tray member;

a support for supporting said planar tray member above the ground; and a connector for detachably connecting said planar tray member to said support;

said planar tray member and said at least one wing providing a first organizing area and a second organizing area, respectively, said planar member comprising a first end and a second end, said at least one wing comprising a first wing coupled to said first end and a second wing coupled to said second end, said first and second wings each defining an organizing area for receiving weapon articles.

28. A portable organizer for use with weapon articles, comprising:

a tray member for receiving a said plurality of weapon articles;

an elongated support member having tray mounting end and a planting end having at least one spike;

an engaging member associated with said planting end for facilitating forcing said spike into the ground; and a connector coupled to an underside of said tray member to facilitate mounting said tray member on said mounting end of said elongated support member.

29. A portable organizer for use with weapon articles, comprising:

a tray member;

an elongated support member having tray mounting end and a planting end having at least one spike;

an engaging member associated with said planting end for facilitating forcing said spike into the ground; and a connector coupled to an underside of said tray member to facilitate mounting said tray member on said mounting end of said elongated support member, said tray member comprising a plurality of troughs which define a plurality of organizing areas for organizing said weapon articles.

30. The portable organizer as recited in claim 29 wherein each of said plurality of troughs comprise a first end and a second end, said first and second ends each comprising a ridge member.

31. A portable organizer for use with weapon articles, comprising:

a tray member;

an elongated support member having tray mounting end and a planting end having at least one spike;

an engaging member associated with said planting end for facilitating forcing said spike into the ground; and a connector coupled to an underside of said tray member to facilitate mounting said tray member on said mounting end of said elongated support member, said tray member comprising a retainer located on said underside for facilitating securing said planting end to said underside when said portable organizer is being transported.

32. The portable organizer as recited in claim 28 wherein said connector defines a generally elongated receiving area for receiving said mounting end of said elongated support member.

33. A portable organizer for use with weapon articles, comprising:

a tray member;

an elongated support member having tray mounting end and a planting end having at least one spike;

an engaging member associated with said planting end for facilitating forcing said spike into the ground; and a connector coupled to an underside of said tray member to facilitate mounting said tray member on said mounting end of said elongated support member, said tray member further comprising a slotted member having an elongated slot which is capable of supporting a rifle cleaning rod and at least one notched area associated with said slot member which is capable of supporting a rifle barrel.

34. The portable organizer as recited in claim 28 wherein said planting end comprises a first leg, a second leg and an engaging member connecting said first and second legs, said engaging member facilitating forcing the planting end into the ground, said first and second legs each having a spike associated therewith.

35. A method for organizing weapon articles, comprising the steps of:

detachably mounting a tray member on a mounting end of an elongated support;

forcing a planting end of said elongated support into the ground; and placing said weapon articles into at least one of a plurality of organizing areas on said tray member.

* * * * *